US006039180A

United States Patent [19]

Grant

[11] Patent Number: 6,039,180

[45] Date of Patent: Mar. 21, 2000

[54] PROTECTIVE SHIPPING CONTAINER FOR FLOWERS

[76] Inventor: Selwyn E. Grant, 2612 S. Beverly Dr., Los Angeles, Calif. 90034-1816

[21] Appl. No.: 09/272,187

[22] Filed: Mar. 18, 1999

[51] Int. Cl.[7] ..... B65D 85/50

[52] U.S. Cl. ..... 206/423; 47/84; 206/509; 220/23.6

[58] Field of Search ..... 206/423, 503, 206/509; 47/41.01, 41.11, 84, 73; D11/143, 144, 146, 147, 155; 220/23.6

[56] References Cited

U.S. PATENT DOCUMENTS

| | | | |
|---|---|---|---|
| 536,908 | 4/1895 | Bailey | 206/423 |
| 580,424 | 4/1897 | Pierson | 206/423 |
| 1,064,813 | 6/1913 | Bloomberg | 206/423 |
| 2,487,168 | 11/1949 | Mordkin | 206/509 X |
| 3,678,620 | 7/1972 | Voges | 206/423 X |
| 4,113,094 | 9/1978 | Collin | 206/423 |
| 4,840,275 | 6/1989 | Faiola et al. | 206/423 |
| 5,217,117 | 6/1993 | Tsuji | 206/423 |

FOREIGN PATENT DOCUMENTS

| | | | |
|---|---|---|---|
| 267180 | 10/1989 | Japan | 206/423 |
| 715219 | 9/1954 | United Kingdom | 206/423 |

*Primary Examiner*—Bryon P. Gehman

*Attorney, Agent, or Firm*—Fulwider Patton Lee & Utecht, LLP

[57] ABSTRACT

A closeable shipping container for containment of a plurality of flowers with stems which includes separated protective bud-containing housings and/or separate stem supports. The container is made of plastic, or other lightweight, but strong materials. The container is dimensioned so that the volume it occupies, per dozen flowers, is most economical to ship.

15 Claims, 4 Drawing Sheets

FIG. 2
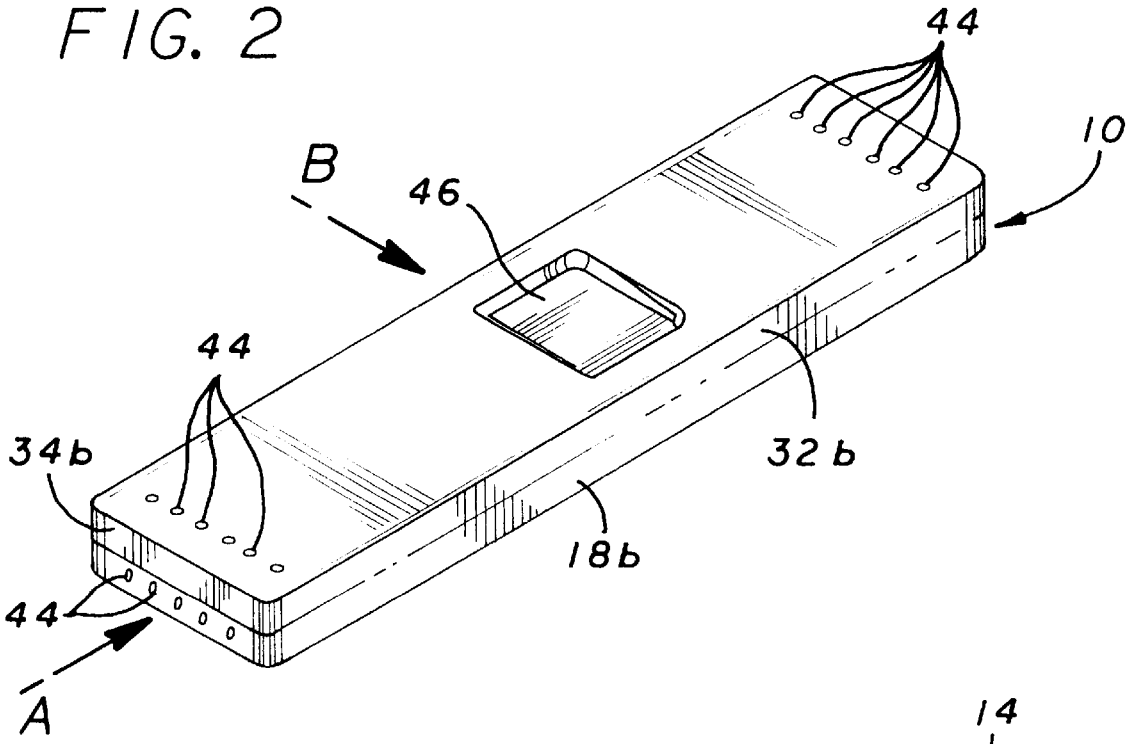
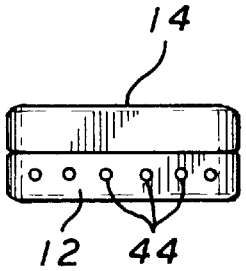
FIG. 3
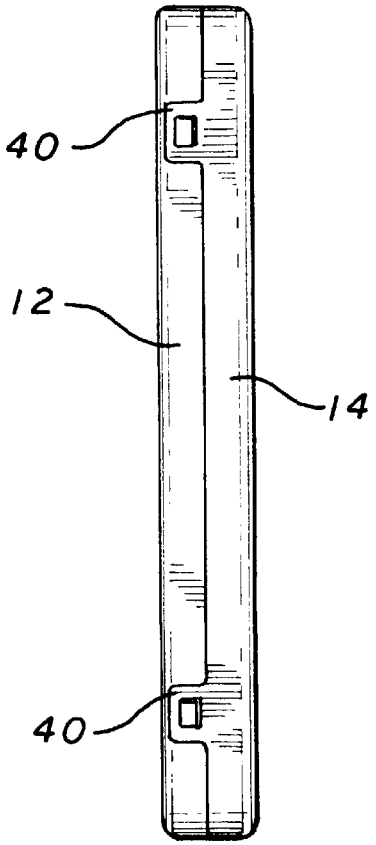
FIG. 4

FIG. 7
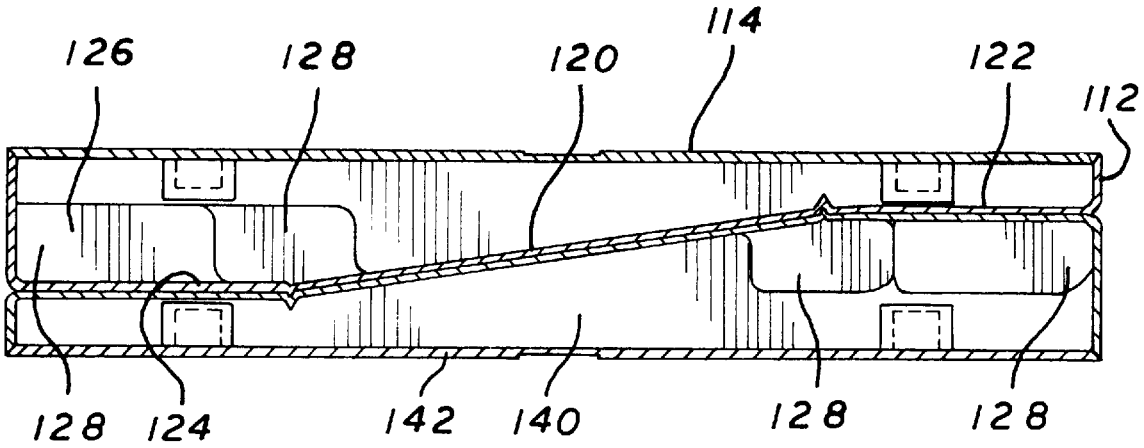
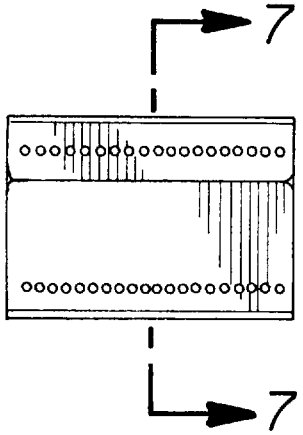
FIG. 6
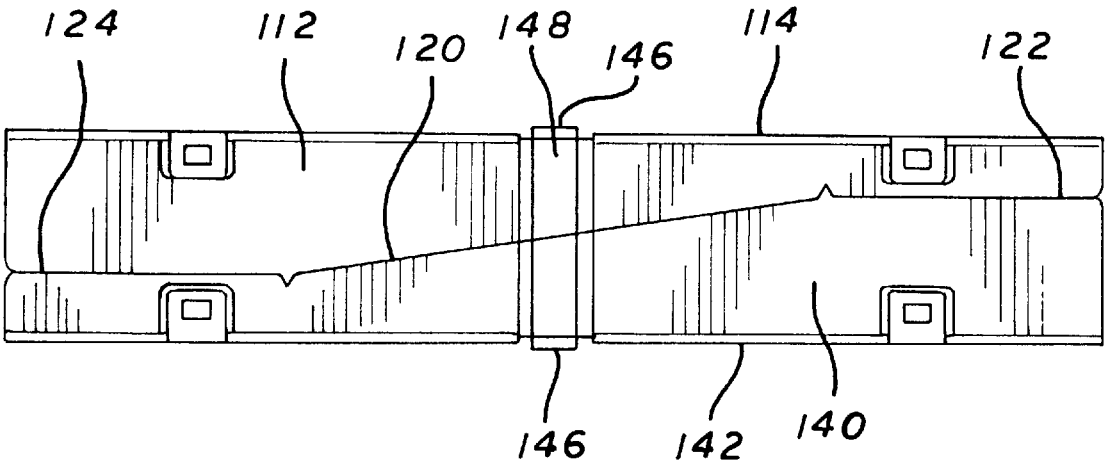
FIG. 8

PROTECTIVE SHIPPING CONTAINER FOR FLOWERS

CROSS-REFERENCE TO RELATED APPLICATION

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to a protective shipping container for flowers, such as roses or tulips. Flowers, such as roses, are grown in areas far removed from the population centers and markets which they serve. Hence, the provisions for shipping of such flowers is an important aspect of the economics of the flower business, and an inexpensive, lightweight, but highly protective shipping container is an optimum requirement.

BRIEF SUMMARY OF THE INVENTION

A closeable shipping container for containment of a plurality of flowers with stems which includes separated protective bud-containing housings and/or separate stem supporting means. The container is made of plastic, or other lightweight, but strong materials. The container is dimensioned so that the volume it occupies, per dozen flowers, is most economical to ship.

BRIEF DESCRIPTION OF THE DRAWINGS

FIG. 2 is a perspective view of FIG. 1 in closed condition;

FIG. 3 is an elevational end view of FIG. 2, as viewed along the direction of arrow A of FIG. 2;

FIG. 4 is a side elevational view of FIG. 2, as viewed along the direction of arrow B of FIG. 2;

FIG. 6 is an end elevational view of the embodiment of FIG. 5 in closed condition, as seen from the right end of FIG. 5;

FIG. 7 is a cross-sectional view taken along line 7—7 of FIG. 6; and FIG. 8 is a side elevational view of FIG. 5 taken in the direction of arrow C of FIG. 5.

DETAILED DESCRIPTION OF THE DRAWINGS

Figure 1:
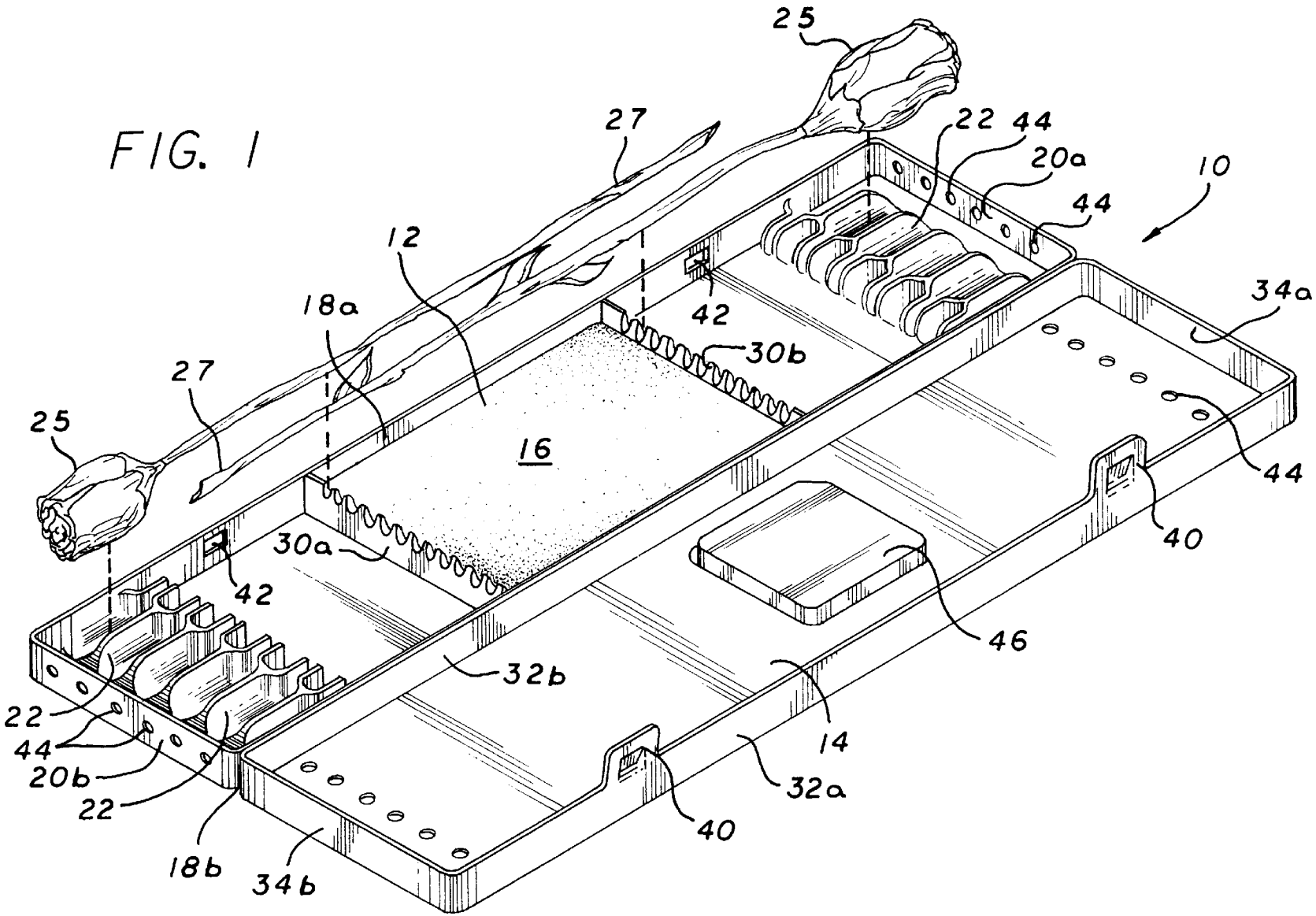
FIG. 1 is perspective view of a first preferred embodiment of my invention showing the interior of the closeable container in open condition.
Figure 5:
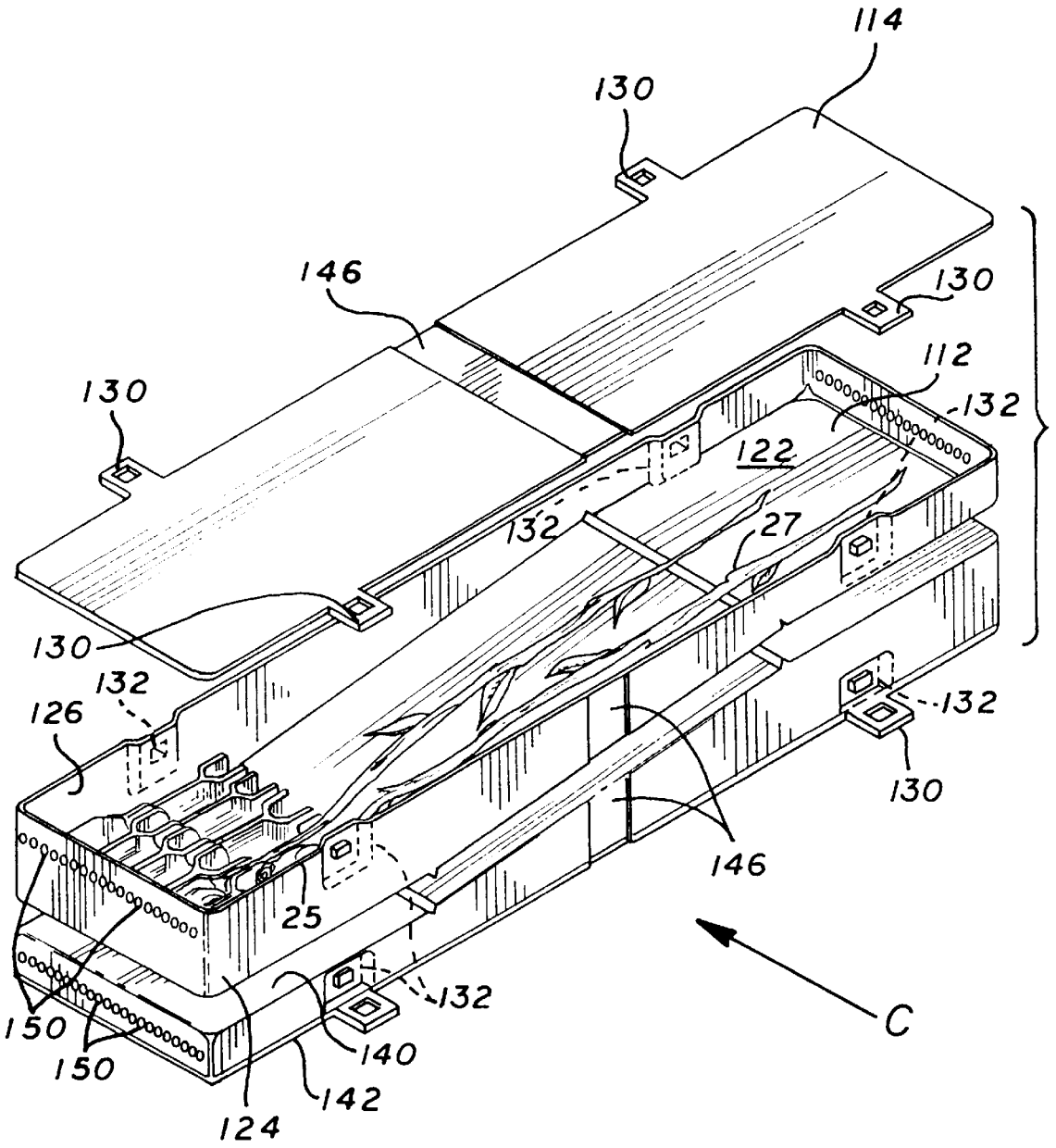
FIG. 5 is an exploded perspective view of a second preferred embodiment of my invention.

The first preferred embodiment of shipping container 10 of my invention, shown in FIG. 1 comprises two elongated compartments 12 and 14, preferably hinged together along the right side wall (see also FIG. 2). Compartment 12 is the base compartment and comprises a flat horizontal floor 16 bounded by upstanding side walls 18*a*, 18*b*, and end walls 20*a*, 20*b*. At either end of base compartment 12 there is provided preferably six separate bud-conforming housings 22, each sized to contain one bud of a flower, e.g. a rose bud

25 whereby six rose buds may be laid within the six bud-conforming housings 22 and their stems 27 laid lengthwise within the base compartment 12, each stem 27 being supported intermediate its ends within notched bridging or support members 30*a*, 30*b*. The manner in which flowers, such as roses, are stably encapsulated within the bud-conforming housings 22 is shown, schematically, in FIG. 1.

The second compartment 14, designated as the lid compartment, also includes upstanding side walls 32*a*, 32*b*, and end walls 34*a*, 34*b*, and is hingeably engaged to the base compartment 12 at sidewall 18*b*. Compartment 14 is closeably engaged with the base compartment 12 by means of fasteners such as tongue and groove members 40, 42. The fastening members 40, 42 are flush with the side walls of the container 10, when the two compartments 12, 14 are closed, as shown in FIG. 3.

Openings 44 are provided at the ends of the container 10 preferably in both compartments 12 and 14 for venting of gases and air communication. In the lid compartment 14, an indented area 46 is provided intermediate its ends 34*a*, 34*b* for affixation of identification indicia.

The compartments 12, 14 the bud-conforming housings 22, the support members 30*a*, 30*b*, and all other components comprising the shipping container 10 are preferably made of conventional moldable plastic materials such as expanded polystyrene foam. Other lightweight conventional plastic materials, such polyethylene terepthalate, may also be used. The container 10 and all of its components parts are preferably integrally molded into a single unit. Container 10, which contains a dozen roses by way of example only, is preferably dimensioned as follows:

Width—10½";

Length—30½"; and

Depth—1⅞"

In the second embodiment of the invention, a base compartment 112 is provided with an intermediate sloping floor portion 120 extending between upper and lower horizontal end portions 122, 124, respectively (See FIGS. 5–8 and FIGS. 5 and 6 in particular). Thus, the interior of the base compartment 112 is provided with a greater depth at the lower horizontal end portion of the base compartment, designated by the numeral 126, to thereby accommodate buds 25 (show in dotted line) within a plurality (e.g. twelve) of separate bud-conforming housings 128 whereas the stems 130 (also shown in dotted line) extend upwardly along, and in contact with, the intermediate sloping floor portion 120, terminating in the upper shallower end 122 of the base compartment 112. The base compartment 112 is closeable by lid panel 114 by conventional fastener means, e.g. by tongue and groove members 130, 132. The resulting closed base/lid container 112, 114 comprises a first container module.

In this second embodiment, a second base and lid compartment 140, 142 identical to the first base and lid compartments 112, 114, comprise a second container module and is aligned with the first module 112, 114 in a manner such that the deeper end of the said first module overlies the shallow end of the second module 140, 142, and the shallow end of the first container module 112, 114 is aligned with the deeper end of the second container module, as shown in FIG. 7. The first and second container modules are then physically bound to each other along slightly indented intermediate area 146 by adhesive means 148 elastic or other binding means.

The resultant first and second modules 112, 114 and 140, 142, when thus aligned, form in geometric terms, a three-dimensional solid having six rectangular surfaces or faces, i.e., a rectangular solid which is an optimum shape for shipping. FIGS. 5–8 illustrate the two modules, each of which contains one dozen roses or other flowers, carefully protected and nestled within their separate bud-conforming housings, the housings being arranged in two rows of six each, the rows extending across the width of the base compartment. The first and second modules 112, 114 and 140, 142 when aligned as shown in FIGS. 5–8 and physically bound are preferably dimensioned as follows:

Width—10½";

Length—30½"; and

Depth—2 13/16"

The base compartments 112 and 140 of each module are preferably integrally formed from moldable plastic materials, as described with reference to the first embodiment, FIGS. 1–4. Openings 150 are provided in the base compartments 112, 140 for venting of gases and air communication.

Modification of the foregoing embodiments may be suggested by those ordinarily skilled in the art, hence; I intend to be bound only by the claims, which follow.

I claim:

1. A protective shipping container for flowers having buds and stems which comprises:

an elongated base compartment having a floor extending between upstanding opposed sidewalls and upstanding opposed endwalls;

a plurality of individual housings integrally formed adjacent at least one of said base compartment endwalls, each of said housings being of such a size and shape as to stably encapsulate each of the buds of the flowers;

an elongated cover overlying said base compartment; and fastening means affixing said elongated cover to said base compartment to form a closed container wherein said elongated cover overlays said housing.

2. The protective shipping container of claim 1 wherein said base compartment has stem support members integrally formed intermediate the opposed endwalls of said base compartment.

3. The protective shipping container of claim 1 wherein said base compartment has notched stem support members integrally formed intermediate the opposed endwalls of said base compartment to retain the individual stems of the flowers.

4. The protective shipping container of claim 1 provided with a plurality of small openings for communication with the air.

5. The protective shipping container of claim 1 made of a moldable plastic material.

6. The protective shipping container of claim 1 wherein said housings are formed adjacent both endwalls of said base compartment.

7. The protective shipping container of claim 1 wherein the depth of the closed container is slightly in excess of the depth of the buds of the flowers.

8. The protective shipping container of claim 1 wherein the floor of the base compartment is generally disposed parallel to the elongated cover.

9. The protective shipping container of claim 1 wherein a portion of the floor of the base compartment is disposed at an angle to the elongated cover whereby the base compartment is provided with a shallow end portion and a deep end portion, the depth of the deep end portion being in excess of the depth of the buds of the flowers; and said individual housings being formed at the deep end portion adjacent the base compartment endwall.

10. The protective shipping container of claim 1 wherein the flowers are roses.

11. A protective shipping container for flowers having buds which comprises:

an elongated base compartment having a floor extending between upstanding opposed sidewalls and upstanding opposed endwalls.

said floor having a lower generally horizontal portion adjacent the opposed endwall, and an intermediate sloping floor portion extending between said lower and upper floor portions;

a plurality of individual housings integrally formed at the said lower horizontal floor portion, each of said housings being of such a size and shape as to stably encapsulate each of the buds of the flowers.

a generally horizontal cover overlying said base compartment; and fastening means affixing said elongated cover to said base compartment to form a closed container wherein said elongated cover overlays said housing.

12. The protective shipping container for flowers of claim 11 wherein a pair of container modules are aligned with respect to each other to form a rectangular solid.

13. The protective shipping container for flowers of claim 11 provided with a plurality of small openings for communication with the air.

14. The protective shipping container for flowers of claim 10 wherein said individual housings are formed in at least two rows extending across the width of each module.

15. The protective shipping container of claim 11 wherein the flowers are roses.

* * * * *

UNITED STATES PATENT AND TRADEMARK OFFICE

CERTIFICATE OF CORRECTION

PATENT NO. : 6,039,180

DATED : Mar. 21, 2000

INVENTOR(S) : Selwyn E. Grant

It is certified that error appears in the above-identified patent and that said Letters Patent is hereby corrected as shown below:

Column 4, line 45, claim 14, change "10", to read --11--.

Signed and Sealed this

Sixth Day of February, 2001

*Attest:*

Q. TODD DICKINSON

*Attesting Officer*

*Director of Patents and Trademarks*